US007114844B2

(12) United States Patent
Weetman

(10) Patent No.: US 7,114,844 B2
(45) Date of Patent: Oct. 3, 2006

(54) AERATION APPARATUS AND METHOD

(75) Inventor: Ronald J. Weetman, Rochester, NY (US)

(73) Assignee: SPX Corporation, Charlotte, NC (US)

( * ) Notice: Subject to any disclaimer, the term of this patent is extended or adjusted under 35 U.S.C. 154(b) by 354 days.

(21) Appl. No.: 10/376,458

(22) Filed: Mar. 3, 2003

(65) Prior Publication Data

US 2004/0174769 A1 Sep. 9, 2004

(51) Int. Cl.
*B01F 7/16* (2006.01)

(52) U.S. Cl. ..... 366/328.3; 416/231 A

(58) Field of Classification Search ..... 366/328.1, 366/328.2, 328.3, 328.4, 330.1, 330.3, 325.93; 261/91; 416/231 R, 231 B, 231 A
See application file for complete search history.

(56) References Cited

U.S. PATENT DOCUMENTS

| | | | | | |
|---|---|---|---|---|---|
| 201,771 | A * | 3/1878 | Freeman | 366/328.2 |
| 285,212 | A * | 9/1883 | Bell et al. | 416/231 B |
| 634,885 | A * | 10/1899 | Glover | 416/231 R |
| 820,405 | A * | 5/1906 | Dunlap | 366/330.3 |
| 1,862,827 | A * | 6/1932 | Parsons et al. | 416/231 R |
| 2,003,073 | A * | 5/1935 | Faber | 416/231 R |
| 2,045,383 | A * | 6/1936 | Faber | 416/231 B |
| 2,149,951 | A * | 3/1939 | Baker | 416/91 |
| 2,160,323 | A * | 5/1939 | Barnett | 416/231 R |
| 3,030,083 | A * | 4/1962 | Stiffler | 416/231 R |
| 3,147,958 | A * | 9/1964 | Stiffler | 366/327.3 |
| 5,316,443 | A * | 5/1994 | Smith | 416/197 R |
| 5,791,780 | A * | 8/1998 | Bakker | 366/317 |
| 5,988,604 | A | 11/1999 | McWhirter | 261/91 |
| 6,190,033 | B1 * | 2/2001 | Rickman et al. | 366/265 |
| 6,464,384 | B1 * | 10/2002 | Kubera et al. | 366/102 |
| 6,715,912 | B1 * | 4/2004 | McWhirter et al. | 366/265 |
| 6,866,414 | B1 * | 3/2005 | Kupidlowski | 366/330.3 |
| 6,877,959 | B1 * | 4/2005 | McWhirter | 416/228 |
| 6,896,246 | B1 * | 5/2005 | Weetman et al. | 261/84 |
| 6,986,507 | B1 * | 1/2006 | Weetman | 261/85 |
| 2004/0228210 | A1 * | 11/2004 | Himmelsbach et al. | 366/330.3 |

* cited by examiner

*Primary Examiner*—Tony G. Soohoo
(74) *Attorney, Agent, or Firm*—Baker & Hostetler LLP

(57) ABSTRACT

The present invention provides an improved aeration impeller for use in a mixing assembly having an axis of rotation. The aeration impeller includes a hub and a first and second blades that are connected to the hub. Each blade has a first portion positioned at an angle to the axis of rotation and a second portion positioned at an angle to the first portion. The first portion of each blade has an opening that at least partially extends the width of the first portion.

12 Claims, 7 Drawing Sheets

AERATION APPARATUS AND METHOD

FIELD OF THE INVENTION

The present invention relates to an improved aeration apparatus and method. More particularly, the present invention relates to an apparatus and method that relates to impellers. The invention is useful, for example, for use in wastewater treatment plants for introducing oxygen into wastewater where the oxygen is used by biological elements that digest the waste. The invention is also useful in various other processes where the transfer of gas and/or oxygen is required.

BACKGROUND OF THE INVENTION

In mass transfer processes such as waste treatment and bio-reactions, it is common to carry out these processes in an aeration vessel in which gas, such as oxygen and/or air, is introduced into a biodegradable liquid for treatment. These aforementioned processes are oftentimes utilized by municipalities and industry to treat waste water wherein the object of the process is to introduce air to the liquid and then the micro-organisms in the liquid proceed to use this oxygen to digest the waste. The gas is commonly introduced by way impellers wherein the impellers aerate the liquid.

During the aeration of a liquid, for example waste water treatment processes, it is common to employ impellers which are especially adapted for use in the aeration of liquids. The impellers are usually employed in an open tank where the impellers are positioned at or on the surface of the liquid in the vessel. Typical surface aerators commonly used in the art are generally either radial flow impellers or pitched blade turbines. The surface aerators use blades that are usually flat rectangular plates which are pitched usually at an angle of 45° to the axis of rotation of the impeller. The aforementioned impellers are commonly located close to the static liquid level surface and a small portion of the width of the blade may project up through the surface. Typically, when the impeller is pitched forwardly, the upper edge of the blade is termed the leading edge while lower edge is termed the trailing edge. Alternatively, typically when the impeller is pitched backwardly, the upper edge is the trailing edge while the lower edge is the leading edge. The liquid is usually either pushed out in front of the angled blade and/or scooped by the blade and discharged radially across the surface of the tank with some of the liquid being sprayed into the atmospheric air from the outer upper surfaces of the blade. As a result of the spraying of the liquid into the atmospheric air, the liquid becomes aerated.

A disadvantage of the above described aeration process is that it is very inefficient. The length of time required to effect the oxidation treatment can be as long as 24 hours. This time period combined with the fact that these waste treatment processes are oftentimes carried out continuously year round, provide a process that is very inefficient in terms of both time consumption and energy consumption.

Accordingly, it is desirable to provide improved surface aeration impellers for effectuating the efficient dispersement or transfer of air and/or other gas into a liquid.

SUMMARY OF THE INVENTION

The present invention relates to impellers which are especially adapted for use in surface aeration of liquids in a tank when disposed on the surface of the liquid in the tank. More particularly, the present invention relates to an improved surface aeration impeller which has hydraulic performance which lends itself to high efficiency of aeration in terms of the mass of oxygen transferred to the liquid per applied energy per unit time. It has been discovered in accordance with the present invention that the aeration efficiency of an impeller can be improved by modifying the spray pattern of the impeller employed in the aeration process, by curving the top portions of the blades that make up the impeller. It also has been discovered that by providing an opening or slot on the impeller blades through which a portion of liquid may pass, aeration efficiency of the impeller can be improved.

The foregoing needs are met, at least in part, by the present invention where, in one aspect, an improved surface aeration impeller for use in a mixing assembly having an axis of rotation is provided. The aeration impeller includes a hub and a first blade having a tip connected to the hub. The first blade has a substantially straight first portion oriented at an angle to the axis of rotation and has a lower edge. The first blade also has a substantially curved second portion having an upper edge. The improved surface aeration impeller additionally has a second blade having a tip connected to the hub. The second blade has a substantially straight first portion oriented at an angle to the axis of rotation and has a lower edge. The second blade also has a substantially curved second portion having an upper edge.

In accordance with another aspect of the present invention, an improved surface aeration impeller for use in a mixing assembly having an axis of rotation is provided. The improved surface aeration impeller includes a hub and has at least one blade having a substantially conical shape connected to the hub.

In accordance with yet another aspect of the present invention, an improved aeration apparatus for use in a mixing assembly for mixing liquid having an axis of rotation is provided. The aeration apparatus includes an aeration impeller. The impeller includes a hub with a first blade connected to the hub having a substantially straight first portion oriented at an angle to the axis of rotation and having a lower edge. The first blade also has a substantially curved second portion that has an upper edge. The impeller also has a second blade connected to the hub having a substantially straight first portion oriented at an angle to the axis of rotation and having a lower edge. The second blade also has a substantially curved second portion that has an upper edge. The improved aeration apparatus also includes a mixing vessel for retaining fluid along with a drive shaft connected to the impeller. The aeration apparatus also has a drive apparatus connected to the shaft that drives the impeller.

In accordance with still another aspect of the present invention, an apparatus for aerating a liquid is provided. The apparatus includes a means for contacting the liquid with air. The means for contacting the liquid with air includes a hub and a first blade connected to the hub having a substantially straight first portion oriented at an angle to the axis of rotation and having a lower edge. The first blade also has a substantially curved second portion that has an upper edge The means additionally has a second blade connected to the hub having a substantially straight first portion oriented at an angle to the axis of rotation and having a lower edge. The second blade connected to the hub that also has a substantially curved second portion that has an upper edge.

In accordance with an additional aspect of the present invention, an improved aeration impeller for use in a mixing assembly is provided having a hub and at least two blades that are connected to the hub. Each blade includes an upper portion, a lower portion, a tip and water separators.

In accordance with another aspect of the present invention, an improved aeration impeller for use in a mixing assembly having a hub and at least two blades connected to the hub. Each blade has an upper portion and a lower portion. The upper portion of the blades has an extension that extends radially from the upper portion above the liquid level in the static state.

In accordance with still another aspect of the present invention, an aeration impeller is provided for use with a liquid mixing assembly having an axis of rotation. The aeration impeller has a first blade and a second blade connected to a hub. The first blade has a first portion positioned at an angle to the axis of rotation and a second portion positioned at an angel to the first portion wherein the first portion has an opening that extends at least partially the width. The second blade has a first portion positioned at an angle to the axis of rotation and a second portion positioned at an angel to the first portion wherein the first portion has an opening that extends at least partially the width.

In accordance with another aspect of the present invention, an aeration impeller is provided for use with a liquid mixing assembly having an axis of rotation. The aeration impeller has a first blade and a second blade connected to a hub. The first blade has a generally straight first portion positioned at an angle to the axis of rotation and a generally curved second portion wherein the first portion has an opening that at least partially extends the width of the first portion. The second blade has a generally straight first portion positioned at an angle to the axis of rotation and a generally curved second portion wherein the first portion has an opening that at least partially extends the width of the first portion.

In accordance with yet another aspect of the present invention, a method for aerating a liquid in a mixing assembly for mixing a liquid having an axis of rotation is provided, comprising the steps of: mixing a liquid; spraying the liquid in an axial direction; and contacting the liquid with air, wherein said mixing and said spraying steps are carried out using an aeration impeller having a hub, a first blade having a substantially j-shaped cross-section connected to the hub, and a second blade having a substantially j-shaped cross-section connected to said hub.

In accordance with another aspect of the present invention, a method of aerating a liquid in a mixing assembly having an axis of rotation is provided, comprising: mixing the liquid; spraying the liquid in both an axial and radial direction; contacting the liquid with air, wherein said mixing and said spraying are carried out using an impeller comprising a hub, a first blade connected to the hub and a second blade connected to the hub, wherein each blade has a first portion positioned at an angle to the axis of rotation and a second portion positioned at an angle to said first portion, wherein the first portion has a width and an opening that at least partially extends the width of said first portion; and passing a portion of the liquid through the opening in the first portion.

There has thus been outlined, rather broadly, several features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

The present invention provides an apparatus and method for mass transfer of gas and/or air into a liquid and/or liquid suspension. The present invention is preferably used in conjunction with waste treatment processes and/or fermentation processes that are commonly carried out in a mixing vessel. In such an arrangement, the mass transfer process is utilized to contact gas and/or oxygen containing gas to a liquid in a mixing vessel or aeration basin. It should be understood, however, that the present invention is not limited in its application to waste treatment, but, for example, can be used with other processes requiring liquid aeration or gas transfer.

Figure 1:
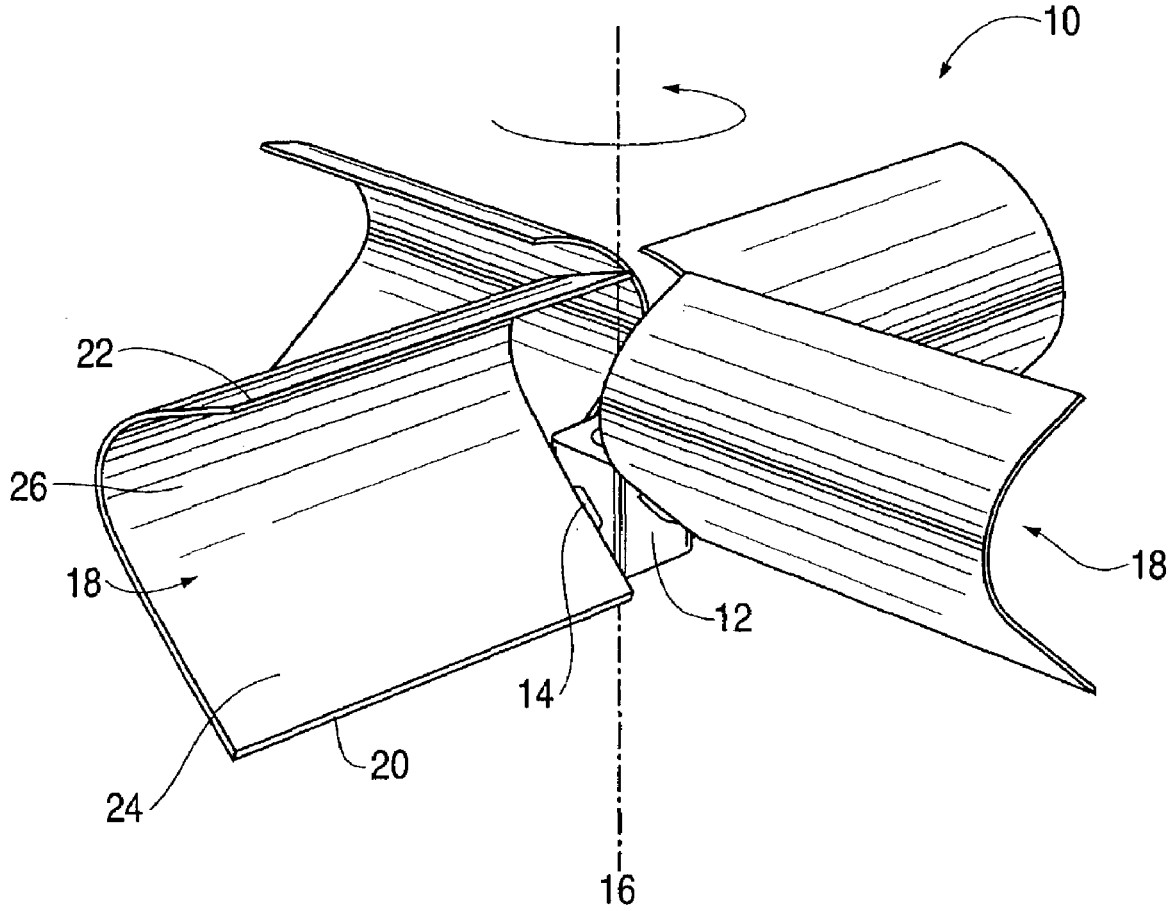
FIG. 1 is a perspective view an aeration impeller in accordance with an embodiment of the present invention.

Referring now to the figures, wherein like reference numerals indicate like elements, FIG. 1 shows a perspective view of a surface aeration impeller 10 in accordance with an embodiment of the present invention. The surface aeration impeller 10 includes a hub 12 that rotates preferably with a shaft (not pictured) of a mixer assembly. The hub 12 includes pin and set screw attachments 14 that extend radially from the hub 12 preferably at an angle equal to 45° with respect to the axis of rotation 16, however, this angle may be increased or decreased depending on impeller application. The surface aeration impeller 10 also includes four blades, generally designated 18, attached to the pins 14 so that they are positioned at a 45° angle to the axis of rotation 16. Each blade 18 has a lower edge 20 and an upper edge 22. In the embodiment depicted, the lower edge 20 is the leading edge while the upper edge 22 is the trailing edge. The blades 18 are preferably attached to the pins 14 by weld attachment. Other attachment means, such as bolts and nuts may be used for attaching the blades 18 to the hub 12.

For descriptive purposes, only one of the blades 18 will be described in detail. Each individual blade 18 is preferably oriented at an angle to the axis of rotation 16 equal to from approximately 20° to approximately 70°. More preferably, the blade 18 is oriented at an angle to the axis of rotation equal to approximately 45°. As depicted in FIG. 1, the blade 18 is a unitary piece that includes a lower, straight portion 24 and a generally upper, curved portion 26. The lower, straight portion 24 is positioned such that it contacts the line of the static liquid level and extends generally upward to the upper, curved portion 26 and the upper/trailing edge 22. As illustrated in FIG. 1, as the blade extends upward from the lower/leading edge 20 to the trailing edge 22, there is a smooth, gradual transition from the lower, straight portion 24 to the upper, curved portion 26 of the blade 18. Preferably, the curved portion 24 has a point at which a line tangent to the curved portion 24 is parallel to the liquid, providing the blade 18 with a substantially j-shaped cross-section. The aforementioned characteristics of the surface aeration impeller 10 combine to provide a more efficient surface aeration impeller 10 in terms of the amount of air transferred to the liquid and in terms of the amount of energy required to rotate the impeller 10 and aerate the liquid.

During operation, the impeller 10 depicted in FIG. 1 is rotated in the counterclockwise direction so that the liquid is "up-pumped" by the impeller 10. By "up-pump" it is understood that the lower edge 20 is the leading edge, the upper edge 22 is the trailing edge and the lower, straight portion acts to scoop or lift the liquid upward. During this process, the upper, curved portion 26 of the blade 18 acts to prevent the overflow of liquid over the upper edge 22 while additionally acting to direct the liquid to flow radially outward. Furthermore, the upper, curved portion 26 functions to provide a more uniform spray pattern at a lower operating power.

As previously mentioned, the upper, curved portion 26 of the blade 18 provides the impeller 10 with increased aeration efficiency. This increased efficiency is due to the gradual transition from the lower, straight portion 24 of the blade 18 to the upper, curved portion of the blade 10, provides a more efficient liquid spray pattern when the impeller is being rotated. During operation, the curved portion 26 combined with the gradual transition region of the blade provides a more efficient liquid spray in terms of aeration by projecting a sheet of spray that is thinner than the sheets of spray that are expelled from conventional surface impellers. In addition, the thinner sheets of liquid provide increased liquid surface area that is exposed to the air, increasing air transfer. Furthermore, the gradual transition and the upper, curved portion 26 enables the blades 18 to project the liquid radially off the blades 18 at a higher velocity than conventional surface aerator impellers, increasing turbulence and therefore increasing aeration.

Figure 2:
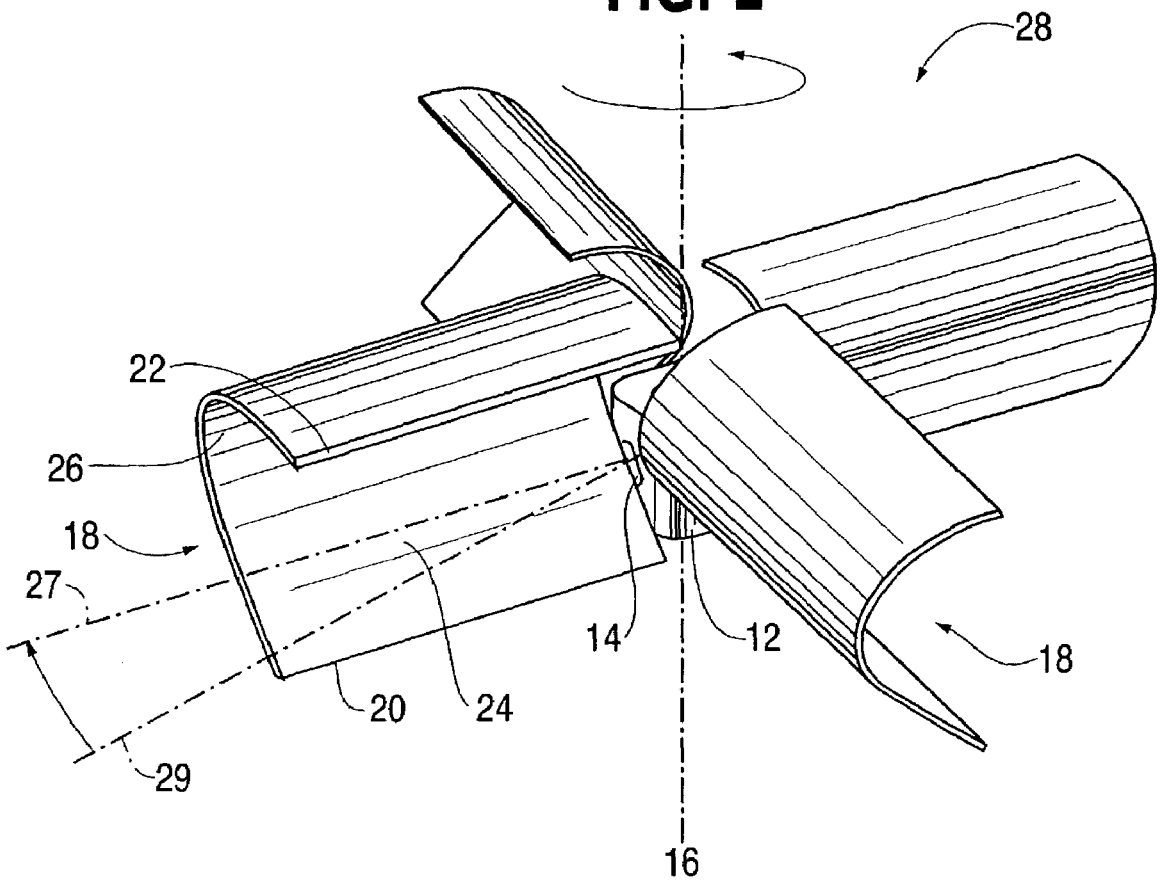
FIG. 2 is a perspective view of an alternate embodiment of the aeration impeller depicted in FIG. 1 in accordance with the present invention.

Referring now to FIG. 2, an alternative embodiment of the surface aerator impeller depicted in FIG. 1 is illustrated in accordance with the present invention. The impeller, generally designated 28, employs the hub 12, the pins 14 and the blades 18 of the previous embodiment, however the blade axis 27 of the impeller 28 are positioned at a "back swept" position to the radial axis 29 of rotation 16. By "back swept" it is understood that the blades 18 are preferably positioned at from approximately 10° to approximately 30° to the blade axis 29 or if one were to extend an imaginary line out directly radial from the hub 12, the center of the blade is positioned behind the line.

Figure 3:
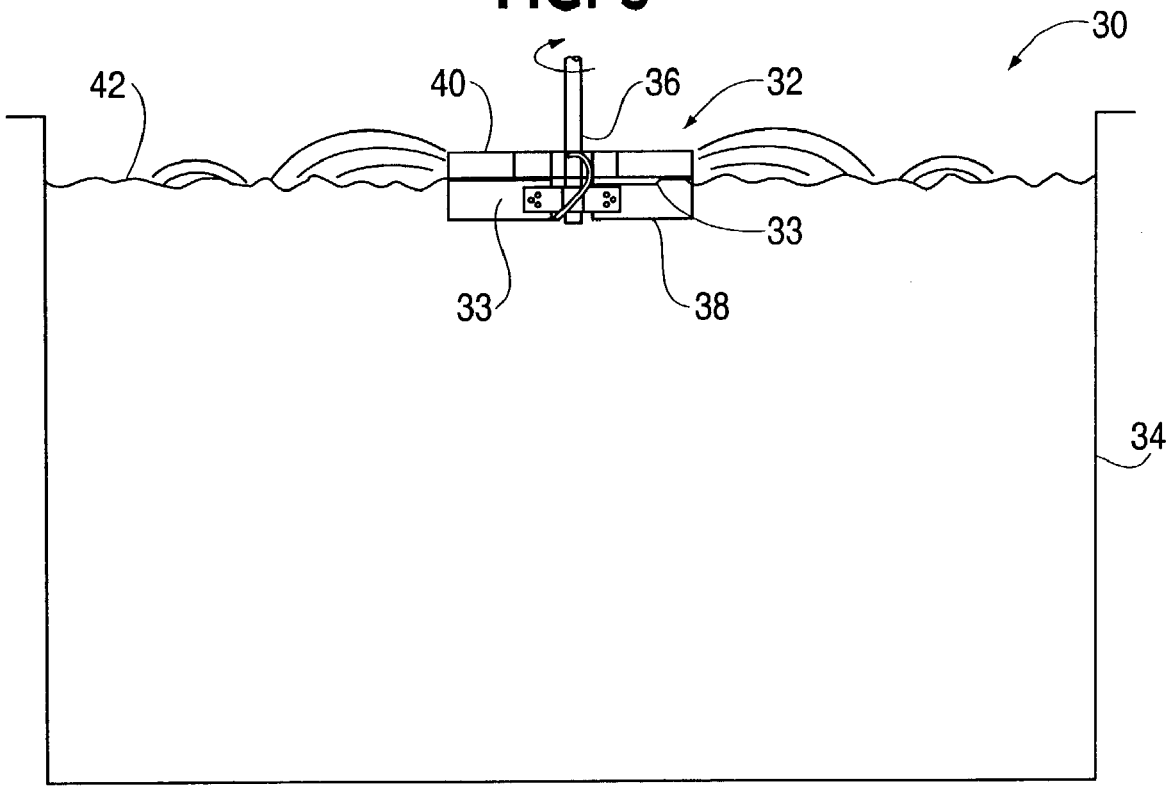
FIG. 3 is a side view of an aeration system including the impellers depicted in FIGS. 1 and 2 in accordance with an embodiment of the present invention.

Referring now to FIG. 3, a mixing apparatus 30 employing either one of the impellers illustrated in FIGS. 1 and 2 is depicted. The impeller 32 is shown located at the center of the mixing vessel 34 which can be a large circular or rectangular vessel containing a large volume of liquid to be mixed and/or aerated. In addition, the diameter or width of the vessel 34 is typically several times the diameter of the impeller 32, approximately 3–6 times the diameter of the impeller in conventional installations. The mixing apparatus 30 also includes a shaft 36 connected to the impeller 32. The shaft 36 is driven by a conventional drive, for example, a motor and gear box (not shown). In the embodiment depicted, the impeller 32 is preferably rotating in an up-pumping direction during operation, thus the lower edges 38 of the blades 33 are the leading edges. The impeller 32 is preferably positioned such that the upper edges 40 (trailing edges) of the blades 33 and the upper, curved portions of the blades 33 are slightly above the surface 42 of the liquid. Due to the aforementioned positioning of the impeller 32 and the curved design of the impeller 32 as previously described, the liquid is smoothly pumped up and across the blades 33 and projected radially across the vessel 34 as a thin spray. The spray then proceeds to drop back onto the surface of the liquid in the vessel 34, splashing and further increasing liquid contact with the air, thereby improving the mass transfer and oxygenation of the liquid.

Figure 4:
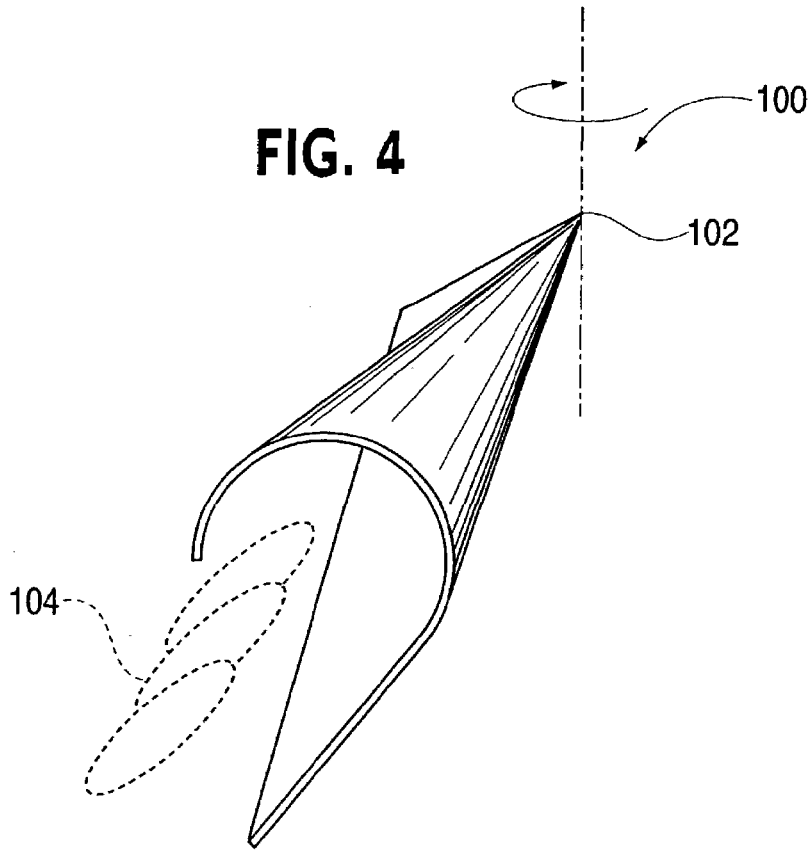
FIG. 4 is a perspective view of an impeller blade having cone-shaped blades in accordance with the present invention.

Referring now to FIG. 4, an improved impeller blade 100 in accordance with an alternative embodiment of the present invention is depicted. As illustrated, the impeller blade 100 has an increased curvature compared to the impellers previously described in FIGS. 1–3. More particularly, the blade 100 is preferably conical or cone shaped wherein the tip of the cone 102 is located at the hub of the impeller (not shown). The aforementioned cone shape provides an increased radial component to the liquid spray coming off the blade causing the spray to rotate as it is expelled from the blade 100, as indicated by reference numeral 104. This increased radial component of the spray 104 increases the turbulence of the liquid, in turn increasing the aeration of the liquid. As depicted, the blade 100 may have a converging and/or diverging blade to assist in the control of liquid spray and turbulence characteristics.

Figure 5:
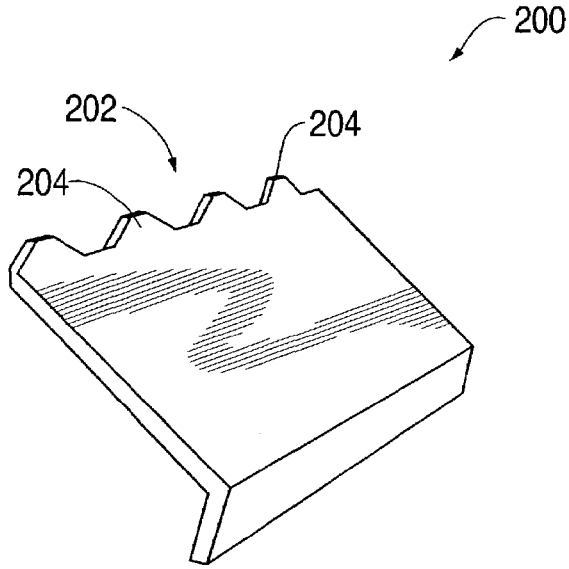
FIG. 5 is a perspective view of an aeration impeller having separators in accordance with an embodiment of the present invention.

Referring now to FIG. 5, an improved impeller blade 200 in accordance with an alternative embodiment of the present invention is depicted. The upper edge 202 of the impeller 200 has one or multiple teeth or separators 204 that are preferably integral with the upper edge 202. As the name suggests, the separators 204 function to separate or break up the sheets of liquid expelled from the blades of the impeller into multiple paths as the impeller is rotating. This provides more liquid components to interact with the air, resulting in increased aeration. The separators 204 can be integral with the blade 200 and/or coupled to the blade by a coupling means. The separators 204 are preferably positioned on the leading edge, the trailing edge and/or the tip of the blade 200. The separators are not limited to blades having the curved shape depicted in FIG. 5, and alternatively, may be used with impellers having various shapes and sizes.

Figure 6:
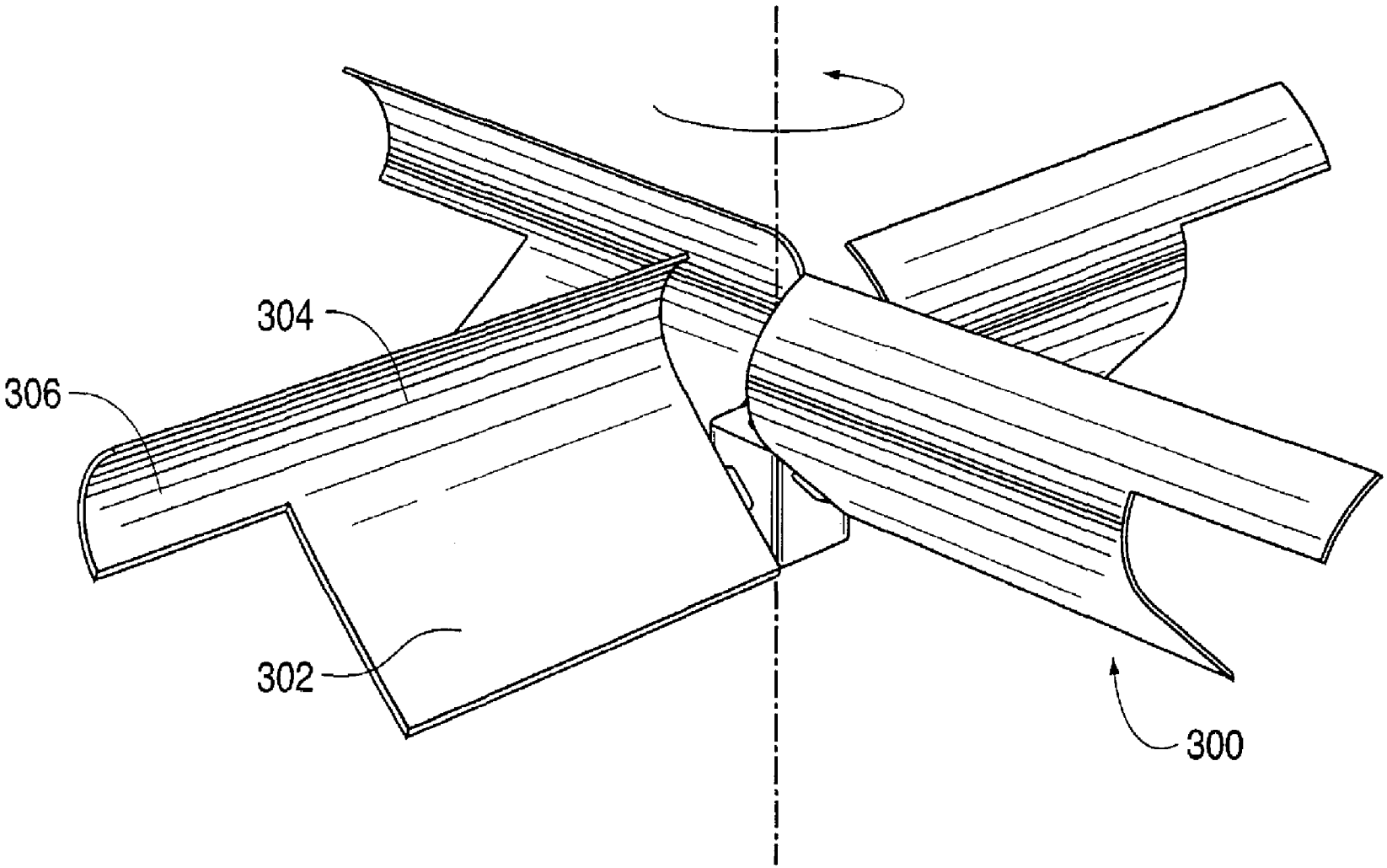
FIG. 6 is a perspective view of an aeration impeller having extension portions in accordance with an embodiment of the present invention.

Referring now to FIG. 6, an improved impeller blade 300 in accordance with an alternative embodiment of the present invention is depicted. The blade 300 has a lower, straight portion 302 and a generally upper, curved portion 304. The blade 300 also includes an extension portion 306 that extends outward from the upper, curved portion 304 and is located above the static water line of the mixing vessel. During operation, the extension portion 306 enables the blade 300 to push and propel liquid out at a larger diameter, causing more liquid spray, increasing liquid aeration efficiency. The extension portion 306 alternatively may be utilized with impellers having various sizes and shapes and is not limited to impeller having curved portions.

Figure 7:
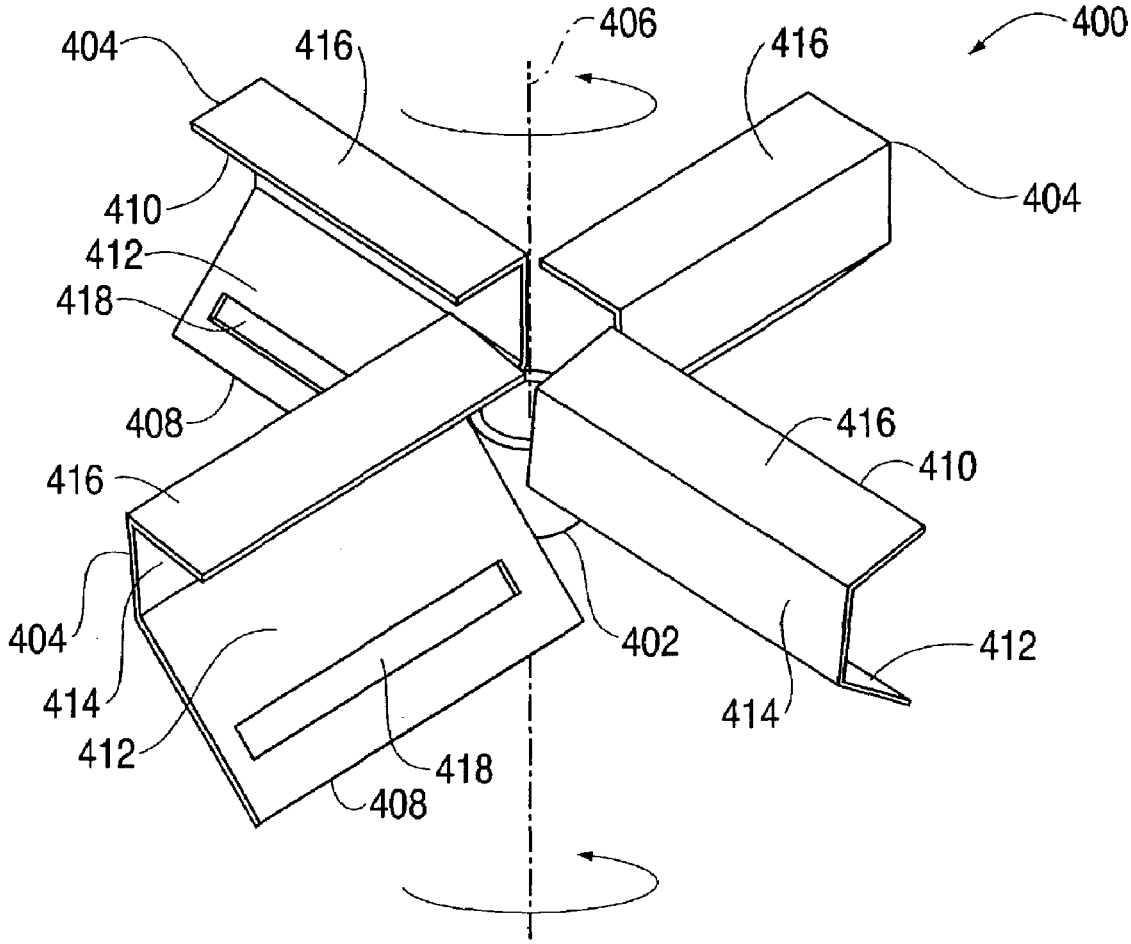
FIG. 7 is a perspective view of an aeration impeller in accordance with an alternative embodiment of the present invention.
Figure 8:
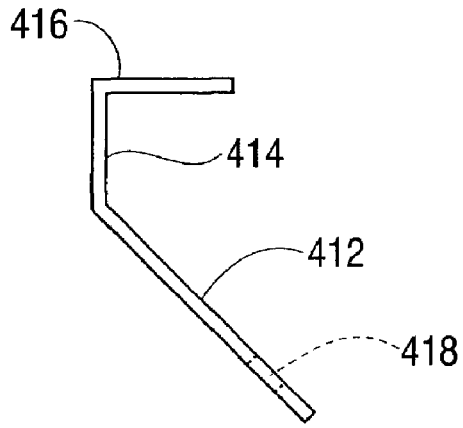
FIG. 8 is a side view of one of the blades of the aeration impeller depicted in FIG. 7.

Referring now to FIGS. 7 and 8, a surface aeration impeller or surface aerator, generally designated 400, is illustrated in accordance with an alternative embodiment of the present invention. The aeration impeller 400 includes a hub 402 that rotates with a shaft (not pictured) of a mixer assembly. The surface aeration impeller 400 also includes four blades, generally designated 404, that are connected and/or attached to the hub 402 via an attachment means such as pin and set screw attachment. The blades 404 are preferably attached to the pins and set screws preferably by weld attachment. Other attachment means, such as bolts and nuts may be used for attaching the blades 404 to the hub 402.

For descriptive purposes, only one of the blades 404 will be described in detail. As depicted in FIGS. 7 and 8, each blade 404 has a lower edge 408 and an upper edge 410. In the embodiment depicted, the lower edge 408 is the leading edge while the upper edge 410 is the trailing edge. The blade 404 is preferably a unitary piece that includes a lower portion 412, a generally upper, vertical portion 414 and a top portion 416. Alternative embodiments included in the present invention may not employ a top portion 416 as illustrated in FIGS. 7 and 8. The lower portion 412 is positioned such that it contacts the static liquid level at a desired angle and extends generally upward to the upper portion 414. The lower portion 412 includes an opening 418, such as a slot, that extends radially across the lower portion 412 of the blade 404. The slot 418 can extend substantially the entire width of the blade 404 or, alternatively, it may extend only a partially across the width of the blade 404.

The opening 418 perforates the lower portion 412 of the blade 404 so that liquid can pass therethrough. The opening 418 is preferably a slot oriented generally perpendicular to the axis of rotation 406 and is positioned on the lower portion 412 approximately at the static liquid level.

As illustrated in FIGS. 7 and 8, as the blade 404 extends upward from the lower/leading edge 408 to the trailing edge 410, the lower portion 412 transitions to the upper portion 414 and the upper portion 414 transitions to the top portion 416. Preferably, the lower portion 412 is positioned at an angle to the axis of rotation equal to from approximately 20° to approximately 75°. More preferably, the lower portion is positioned at an angle to the axis of rotation equal to approximately 45°.

The upper portion 414 is oriented generally parallel to the axis of rotation 406 so that it is generally perpendicular to the static liquid level. The top portion 416 is preferably positioned at an approximate 90° angle to the upper portion 414 so that it is generally parallel to the liquid level. The aforementioned characteristics of the blade 404 of the surface aerator 400 combine to provide a more efficient surface aeration impeller 400 in terms of the amount of air transferred to the liquid and in terms of the amount of energy required to rotate the impeller 400 and aerate the liquid.

During operation, the impeller 404 as illustrated in FIGS. 7 an 8, is rotated in the counterclockwise direction so that the liquid is "up-pumped" by the impeller 400. By "up-pump" it is understood that the lower edge 408 is the leading edge, the upper edge 410 is the trailing edge wherein the lower portion 412 acts to scoop or lift the liquid. During this process, some of the liquid passes through the opening 418 while some of the liquid is pumped radially outward.

The opening 418, lower 412, upper 414 and top 416 portions of the blade 404 combine to provide a more efficient surface aerator 400. The openings 418 allows the pressure imposed on the surface aerator 400 from rotation to be reduced and/or equalized, by allowing some of the liquid to pass therethrough. As a result, the amount of energy required to rotate the aerator is reduced.

In addition, the above-described features combine to provide a more efficient liquid spray pattern in terms of aeration by projecting a sheet of liquid that is thinner than the sheets of liquid that are projected from conventional surface aerators. In addition, the thinner sheets of liquid provide increased liquid surface area that can be exposed to the air, increasing liquid aeration. Furthermore, the combination of the lower portion, upper portion 414 and top portion 416 combine to project the liquid radially off the blades 404 at a higher velocity that conventional surface aerators, increasing turbulence and therefore increasing aeration.

Figure 9:
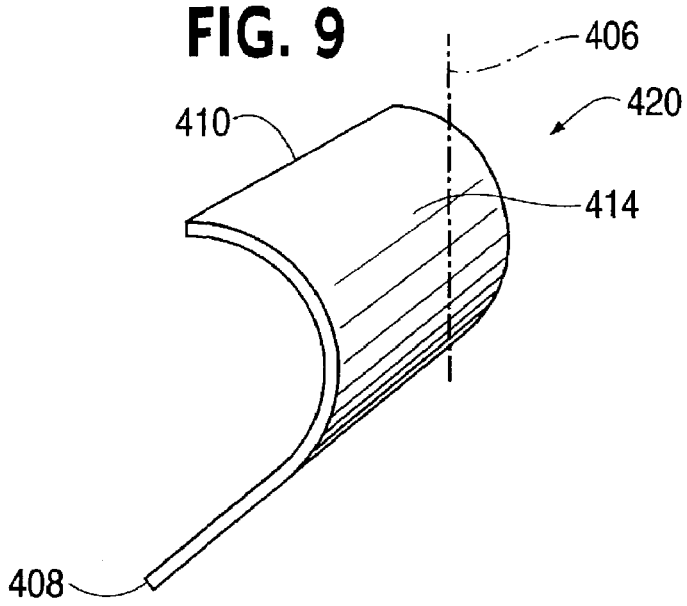
FIG. 9 is a perspective view of an aeration impeller blade in accordance with an alternative embodiment of the present invention.
Figure 10:
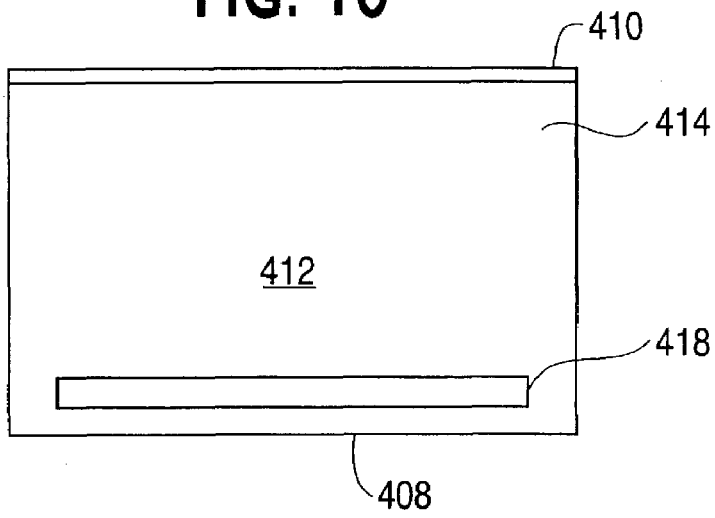
FIG. 10 is a front view of the aeration impeller blade depicted in FIG. 9.
Figure 11:
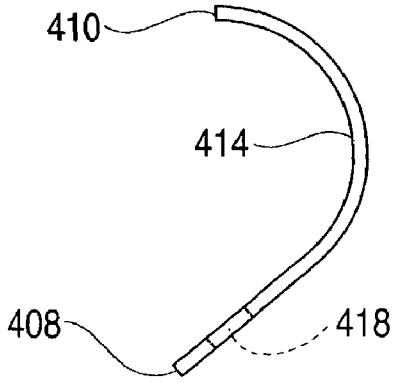
FIG. 11 is a side view of the aeration impeller blade depicted in FIGS. 9 and 10.

Referring now to FIGS. 9–11, a surface aerator blade 420 in accordance with an alternative embodiment of the present invention is depicted. The blade 420 is preferably a unitary piece similar to the embodiment illustrated in FIGS. 7 and 8 having a lower portion 412, an opening such as a slot 418 and an upper portion 414. As illustrated in FIGS. 9–11, the lower portion is generally straight while the upper portion is generally curved wherein there is a general transition from the lower portion 412 to the upper portion 414. The lower portion 412 is preferably positioned such that it contacts the static liquid level and extends generally upward to the upper, curved portion 414 and the upper/trailing edge 410.

The upper curved, portion 414 preferably has a point at which a line tangent to the curved portion 24 is parallel to the liquid, providing the blade 420 with a substantially J-shaped cross-section. The upper curved portion 414 acts to prevent the overflow of liquid over the upper edge 410 while additionally acting to direct the liquid to flow radially outward at higher velocities than convention surface aerators. The aforementioned higher velocities function to increase liquid surface turbulence and therefore increase liquid aeration.

As previously described in connection with the embodiment depicted in FIGS. 7 and 8, the opening 418 allows the pressure imposed on the surface aerator 400 to be reduced and/or equalized by allowing some of the liquid to pass therethrough. The aforementioned characteristics of the blade 420 combine to provide a more efficient surface aerator in terms of the amount of air transferred to the liquid and in terms of the amount of energy required to rotate the aerator and aerate the liquid.

It should be understood that the structures shown throughout the figures and described herein are representative examples of embodiments in accordance with the present invention utilized mixing apparatus and/or mixing assembly wherein the liquid is up-pumped. The invention is not limited to use with up-pumping mixing apparatuses and can be used in alternative mixing apparatuses such as mixing assemblies that require the down-pumping of fluid.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An aeration impeller for use in a liquid mixing assembly having an axis of rotation, comprising:

a hub;

a first blade connected to said hub, said first blade having in profile a generally straight first portion positioned at an angle to the axis of rotation, the first portion having a first free lower end and an upper region, and a generally straight second portion positioned at an angle to said first portion and oriented substantially parallel to the axis of rotation, wherein said first portion has a width and comprises an opening that at least partially extends the width of said first portion, and a generally straight third portion positioned at an angle equal to approximately 90 degrees to the second portion and oriented substantially perpendicular to the axis of rotation, the third portion having a second free forward facing end and a rear region, wherein the second portion spans between the upper region of the first portion and the rear region of the third portion; and a second blade connected to said hub, said second blade having in profile a generally straight first portion positioned at an angle to the axis of rotation, the first portion having a first free lower end and an upper region, and a generally straight second portion positioned at an angle to said first portion and oriented substantially parallel to the axis of rotation, wherein said first portion has a width and comprises an opening that at least partially extends the width of said first portion, and a generally straight third portion positioned at an angle equal to approximately 90 degrees to the second portion and oriented substantially perpendicular to the axis of rotation, the third portion having a second free forward facing end and a rear region, wherein the second portion spans between the upper region of the first portion and the rear region of the third portion.

2. The aeration impeller according to claim 1, wherein said first portion of said first and second blades is positioned at an angle to the axis of rotation equal to approximately 45 degrees.

3. The aeration impeller according to claim 1, wherein said openings are generally positioned at the liquid level.

4. The aeration impeller according to claim 1, wherein said openings are slots.

5. The aeration impeller according to claim 1, further comprising a plurality of blades connected to said hub, said plurality of blades each having a first portion positioned at an angle to the axis of rotation and a second portion positioned at an angle to said first portion, wherein said first portion has a width and comprises an opening that at least partially extends the width of said first portion.

6. The aeration impeller according to claim 5, wherein said openings are generally positioned at the liquid level.

7. The aeration impeller according to claim 5, wherein said openings are slots.

8. The aeration impeller according to claim 1, wherein in profile the length of the first portion is greater than the length in profile of the third portion.

9. The aeration impeller according to claim 1, wherein in profile the length of the first portion is greater than the length in profile of the second portion.

10. A liquid mixing assembly comprising:

a mixing vessel;

a shaft;

an impeller supported by the shaft for rotation about an axis of rotation, the impeller comprising a hub, a first blade connected to the hub and a second blade connected to the hub, wherein each blade in profile has a generally straight first portion positioned at an angle to the axis of rotation, the first portion having a first free lower end and an upper region, and a generally straight second portion positioned at an angle to said first portion and oriented substantially parallel to the axis of rotation, wherein the first portion has a width and comprises an opening that at least partially extends the width of said first portion, and a generally straight third portion positioned at an angle equal to approximately 90 degrees to the second portion and oriented substantially perpendicular to the axis of rotation, the third portion having a second free forward facing end and a rear region, wherein the second portion spans between the upper region of the first portion and the rear region of the third portion.

11. The mixing assembly according to claim 10, wherein in profile the length of the first portion is greater than the length in profile of the third portion.

12. The mixing assembly according to claim 10, wherein in profile the length of the first portion is greater than the length in profile of the second portion.

* * * * *